US008967279B2

(12) United States Patent
Hered et al.

(10) Patent No.: US 8,967,279 B2
(45) Date of Patent: Mar. 3, 2015

(54) REINFORCED SHEAR COMPONENTS AND METHODS OF USING SAME

(71) Applicant: Baker Hughes Incorporated, Houston, TX (US)

(72) Inventors: William A. Hered, Houston, TX (US); Jason J. Barnard, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 220 days.

(21) Appl. No.: 13/734,242

(22) Filed: Jan. 4, 2013

(65) Prior Publication Data

US 2014/0190707 A1 Jul. 10, 2014

(51) Int. Cl.

| | |
|---|---|
| ***E21B 17/06*** | (2006.01) |
| ***E21B 21/10*** | (2006.01) |
| ***E21B 34/14*** | (2006.01) |
| *E21B 34/00* | (2006.01) |

(52) U.S. Cl.

CPC ..... *E21B 17/06* (2013.01); *E21B 21/103* (2013.01); *E21B 34/14* (2013.01); *E21B 2034/007* (2013.01)

USPC ..... 166/381; 166/242.6; 411/4

(58) Field of Classification Search

USPC ..... 166/376, 381, 242.6, 242.7; 411/2, 3, 4, 411/5

See application file for complete search history.

(56) References Cited

U.S. PATENT DOCUMENTS

| | | | | |
|---|---|---|---|---|
| 2,865,076 | A * | 12/1958 | Newton et al. | 411/347 |
| 3,878,889 | A | 4/1975 | Seabourn | |
| 4,260,017 | A | 4/1981 | Nelson | |
| 4,446,932 | A * | 5/1984 | Hipp | 175/74 |
| 4,537,255 | A | 8/1985 | Regalbuto et al. | |
| 5,180,016 | A | 1/1993 | Ross et al. | |
| 6,287,079 | B1 * | 9/2001 | Gosling et al. | 416/220 R |
| 7,878,253 | B2 | 2/2011 | Stowe et al. | |
| 2003/0168214 | A1 | 9/2003 | Sollesnes | |
| 2005/0045338 | A1 | 3/2005 | Howlett | |
| 2005/0281968 | A1 | 12/2005 | Shanholtz et al. | |
| 2010/0113208 | A1 | 5/2010 | Haugeberg | |
| 2010/0252273 | A1 | 10/2010 | Duphorne | |
| 2011/0132143 | A1 | 6/2011 | Xu et al. | |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135953 | A1 | 6/2011 | Xu et al. | |
| 2011/0136707 | A1 | 6/2011 | Xu et al. | |
| 2012/0024109 | A1 | 2/2012 | Xu et al. | |
| 2012/0255743 | A1 | 10/2012 | Oxford | |

OTHER PUBLICATIONS

International Searching Authority; ISR&WO issued in PCT/US2013/071336 dated Feb. 16, 2014.

* cited by examiner

*Primary Examiner* — William P Neuder
(74) *Attorney, Agent, or Firm* — Parsons Behle & Latimer

(57) ABSTRACT

A shear component for releasably securing a first component to a second component, the shear component comprising a body having a first end, a second end, an outer wall surface, an inner wall surface defining a cavity, a shear plane, and a core disposed within the cavity and in sliding engagement with the inner wall surface of the body. The core comprises a first position in which the core is disposed in alignment with the shear plane, and a second position in which the core is disposed out of alignment with the shear plane. The shear component can be included in a downhole tool to maintain the downhole tool in the run-in or initial position until being compromised by a stimulus.

28 Claims, 4 Drawing Sheets

REINFORCED SHEAR COMPONENTS AND METHODS OF USING SAME

BACKGROUND

1. Field of Invention

The invention is directed to releasable members that retain one element in a position relative to another element until such time as an outside stimulus causes the releasable member to actuate and allow movement of at least one of the elements to move relative to the other element and, and in particular, to a shear component that retains the two elements in a first position until being broken and allowing at least one of the elements to move relative to the other element.

2. Description of Art

Shear components such as shear pins and shear screws are known in the art. In general, a shear component is used to retain one element to another element until a predetermined event occurs causing the shear component to release the connection between the two elements. In one specific example, a shear component such as shear pin or shear screw is inserted through the wall of a first element, such as a slidable sleeve, and into the wall of a second element, such as a mandrel, to retain the slidable sleeve in a first or fixed position. Upon application of a stimulus, such as an increase in pressure across the shear component, the shear component is compromised by being broken into two or more pieces allowing the first element to move relative to the second element. Applications of shear components include downhole tools used in oil and gas exploration and production environments where the tool is disposed within the well and pressure is applied to the shear component. At a predetermined pressure level, the shear component breaks allowing movement of one element of the tool, such as a slidable sleeve to actuate the downhole tool.

SUMMARY OF INVENTION

Broadly, shear components for releasably securing a first component to a second component comprise a body having a first end, a second end, an outer wall surface, an inner wall surface defining a cavity, a shear plane, and a core disposed within the cavity and in sliding engagement with the inner wall surface of the body. The core shifts between a first position in which the core is disposed in alignment with the shear plane, and a second position in which the core is disposed out of alignment with the shear plane. When in the first position, the core provides added strength to the shear component to mitigate the risk of prematurely shearing the component. When in the second position, the amount of force required to compromise or fail the shear component is reduced. Accordingly, the now vacant cavity across the shear plane has a shear strength less than a traditional element. As a result, the shear component provides selective strengthening depending on the location of the core within the cavity.

The shear component can be included in a downhole tool to maintain the downhole tool in the run-in or initial position until being compromised by a stimulus.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
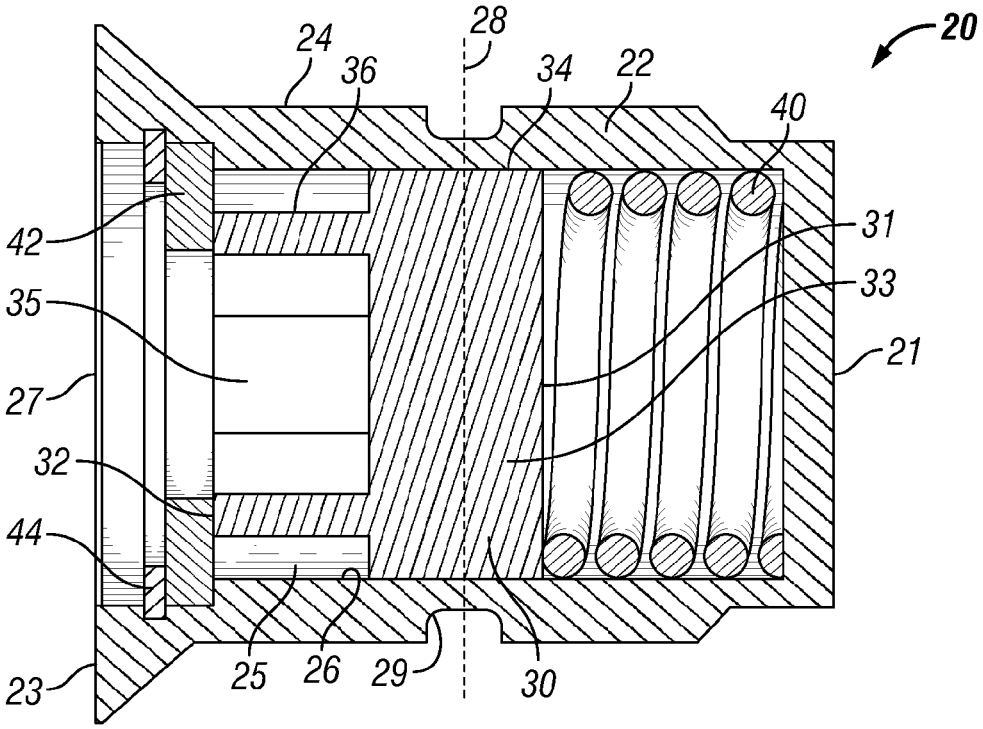
FIG. 1 is a cross-sectional view of a specific embodiment of a shear component disclosed herein shown in a first position.
Figure 2:
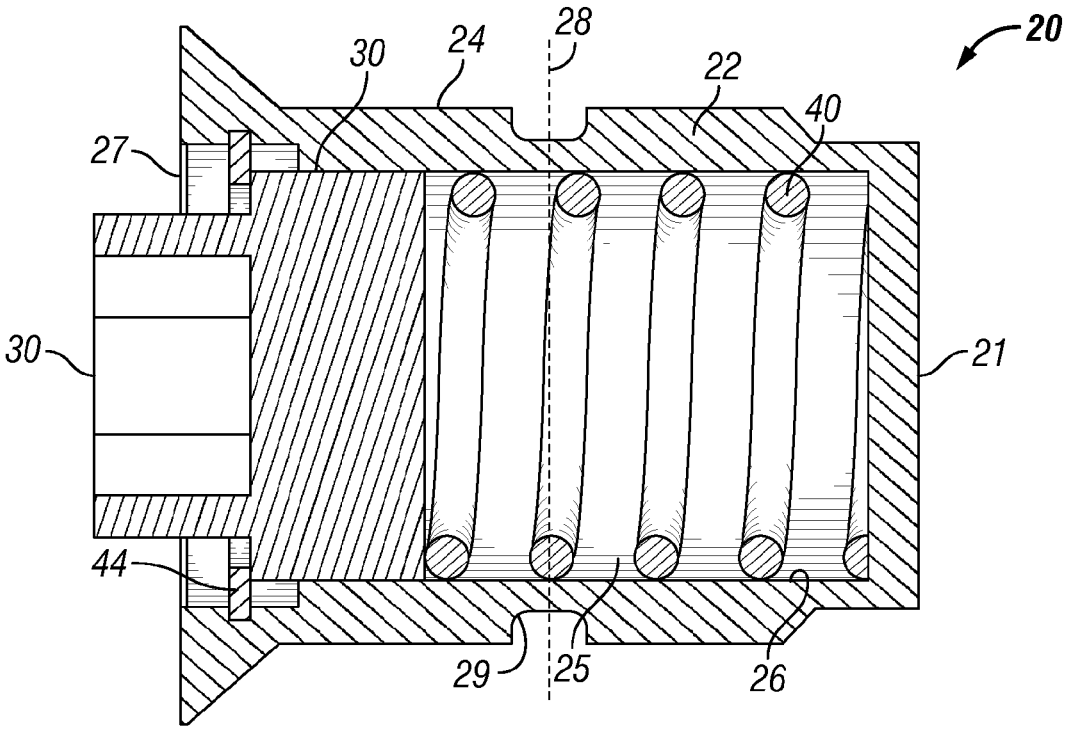
FIG. 2 is a cross-sectional view of the shear component shown in FIG. 1 shown in a second position.

Referring now to FIGS. 1-2, in one specific embodiment, shear component 20 comprises body 22 having first end 21, second end 23, outer wall surface 24, and cavity 25 defined by inner wall surface 26. Outer wall surface 24 includes groove 29 disposed along shear plane 28. Shear plane 28 is the plane passing through body 22 which is the weakest point along body 22 and along which body 22 is compromised or broken.

In the embodiment of FIGS. 1-2, first end 21 is closed and second end 23 includes opening 27 that is in fluid communication with cavity 25. It is to be understood, however, that first end 21 is not required to be closed. Disposed within cavity 25 in sliding engagement with inner wall surface 26 is core 30. Core 30 includes first end 31, second end 32, first portion 33 having outer diameter 34, and second portion 35 having outer diameter 36. Outer diameter 34 is in sliding engagement with inner wall surface 26. Outer diameter 36 is smaller than outer diameter 34 and is not in sliding engagement with inner wall surface 26. Although core 30 is shown as having two portions, 33, 35 with portion 33 having an outer diameter 34 that is greater than the outer diameter 36 of portion 35, core 30 is not required to have this configuration. Instead, core 30 can have a single portion of which the entire outer diameter is in sliding engagement with inner wall surface 26 of body 22.

Core 30 has a first position (FIG. 1) and a second position (FIG. 2). In the first position, core 30 is disposed within cavity 25 across, or in alignment with, shear plane 28 and held between actuator 40 and corrodible member 42 with corrodible member 42 being held in place by retaining ring 44. Thus, in the first position, the shear strength of body 22 is higher across shear plane 28 as compared to when core 30 is moved out of alignment of shear plane 28, thereby reducing the possibility of unintentionally shearing. Core 30 can be formed out of any material desired or necessary to provide strength to shear component 20 such that reduces the likelihood of unintentional shearing. Suitable materials include alloy steels.

In the embodiment of FIGS. 1-2, actuator 40 comprises a compressive member shown as a spring. However, the compressive member is not required to be a coiled spring, but instead can be an elastomeric material, Belleville washers, or any other material or device that can be compressed to store energy that can later be released to facilitate movement or actuation of core 30 from the first position to the second position.

As used herein "corrodible member" means that the member is capable of being corroded, dissolved, degraded, disintegrated or otherwise compromised by a stimulus such that it can no longer provide the function for which it was designed. Thus, corrodible member 42 is initially designed to maintain core 30 in the first position (FIG. 1) and, as it is corroded or otherwise has its integrity compromised, it can no longer maintain core 30 in the first position. Suitable corrodible materials for forming corrodible member 42 include, but are not limited to electrolytic materials such as those disclosed and described in U.S. Patent Publication No. 2011/0132620 filed in the name of Agrawal, et al., U.S. Patent Publication No. 2011/0132619 filed in the name of Agrawal, et al., U.S. Patent Publication No. 2011/0132621 filed in the name of Agrawal, et al., U.S. Patent Publication No. 2011/0136707 filed in the name of Xu, et al., U.S. Patent Publication No. 2011/0132612 filed in the name of Agrawal, et al., U.S. Patent Publication No. 2011/0135953 filed in the name of Xu, et al., U.S. Patent Publication No. 2011/0135530 filed in the name of Xu, et al., and U.S. Patent Publication No. 2012/0024109 filed in the name of Xu, et al., each of which is hereby incorporated by reference in its entirety.

In addition, corrodible member 42 is not required to be formed completely out of a corrodible material. To the contrary, portions of corrodible member 42 can be formed out of non-corrodible materials. For example, corrodible member 42 may include pieces of non-corrodible material that are held together by one or more corrodible materials. In these examples, the corrodible material portions are corroded or otherwise become compromised causing the entire corrodible member 42 to break apart. Thus, while not all of the corrodible member 42 is "corroded," it is sufficiently compromised to permit core 30 to move from its first position (FIG. 1) to its second position (FIG. 2).

When core 30 is in the first position (FIG. 1), actuator 40 is in its initial position. In embodiments such as the one illustrated in FIGS. 1-2, when actuator 40 is a compressible member, the compressible member is in its compressed position when core 30 is in the first position such that the compressible member is biased toward second end 23. In other words, the compressive member contains stored energy that is trying to push core 30 toward second end 23 but is unable to do so due to corrodible member 42 and retaining ring 44.

Figure 6:
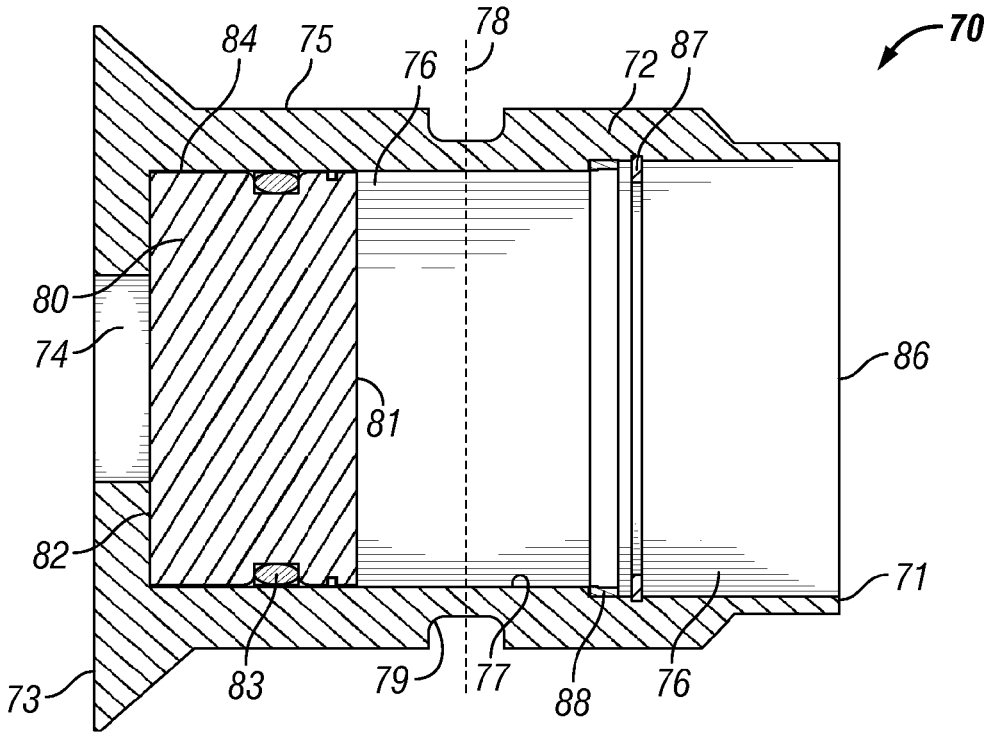
FIG. 6 is a cross-sectional view of the shear component shown in FIG. 5 shown in a second position.
Figure 7:
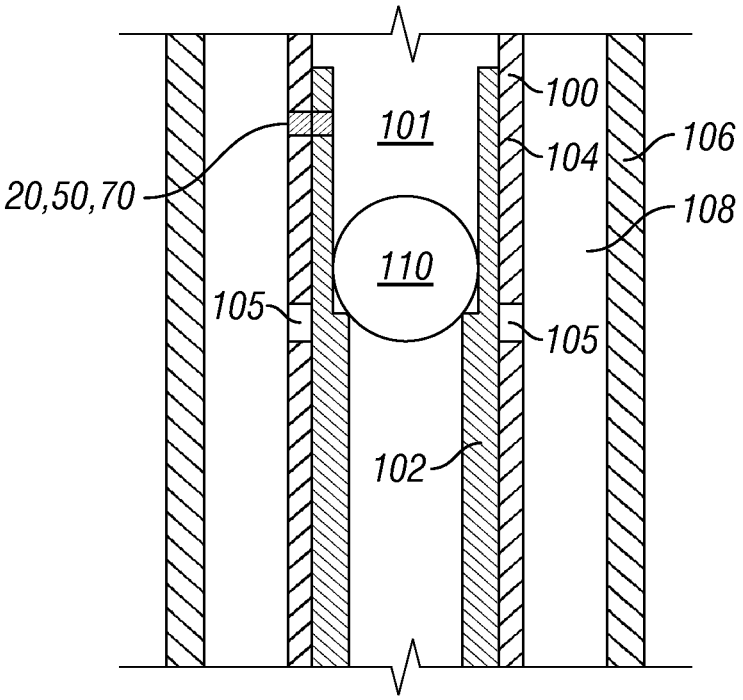
FIG. 7 is a cross-sectional view of a downhole tool disposed in wellbore showing shear components of the embodiments of FIGS. 1-6 retaining the downhole tool in its run-in position.
Figure 8:
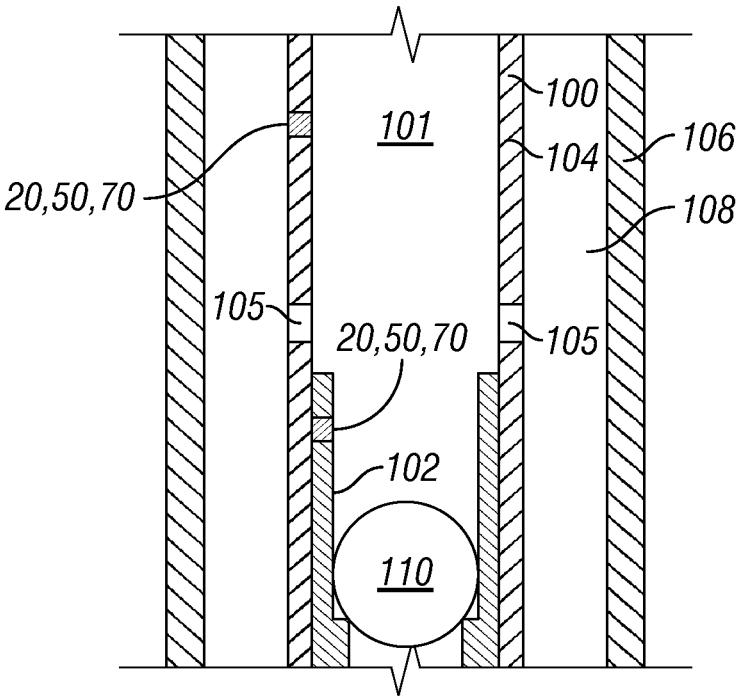
FIG. 8 is a cross-sectional view the downhole tool of FIG. 7 showing the shear components of the embodiments of FIGS. 1-6 having been compromised so that the downhole tool has moved to its set position.

In operation of the embodiment of FIGS. 1-2, and with further reference to FIGS. 7-8, downhole tool 100 (FIGS. 7-8) is shown disposed within wellbore 106 to define wellbore annulus 108. Downhole tool 100 is illustrated as a ball seat having first and second components 102, 104 initially held in place relative to one another by shear component 20, 50, 70. Shear components 50 and 70 are discussed in greater detail below with respect to FIGS. 3-6. Shear component 20, 50, 70 is disposed through first component 102 and second component 104 (FIG. 7) such that first ends 21, 51, 71, and second ends 23, 53, 72 are exposed to bore 101 of downhole tool 100 and wellbore annulus 108, respectively. However, it is to be understood, that in the embodiment of FIGS. 1-2, first end 21 can be exposed to either bore 101 or wellbore annulus 108.

After assembly, downhole tool 100 is run-in to wellbore 106 to the desired location on a work or tool string (not shown). A stimulus such as a corrosive fluid either already disposed in the wellbore, or pumped down the wellbore, or pumped down bore 101, acts on corrodible member 42 causing it to be compromised such as through dissolution, degradation, or other known mechanism due to the corrosive fluid passing through opening 27. Upon corrodible member 42 being compromised, the actuator is actuated from its initial position to its actuated position. As illustrated in the embodiment of FIGS. 1-2, the stored energy within the compressive member is released causing the compressive member to move from a compressed or stored energy position (FIG. 1) to an expanded or released energy position (such as shown in FIG. 2). As a result, core 30 is pushed toward second end 23 until it is no longer disposed across, or in alignment with, shear plane 28. By moving core 30 out of alignment with shear plane 28, body 22 of shear component 20 is weakened so that body 22 is more readily compromised or broken due to a stimulus such as gravity, mechanical force, or fluid pressure acting on shear component 20. With reference to FIGS. 7-8, shear component 20 is compromised by fluid pressure building above ball 110 forcing ball 110 into first component 102 which, in turn, exerts force across shear plane 28 of shear component 20. After shear component 20 is compromised or otherwise fails, first component 102 is permitted to move relative to second component 104 such as shown in FIG. 8 so that a downhole operation is performed by the downhole tool. In the case of downhole tool 100, ports 105 are opened such that bore 101 is placed in fluid communication with wellbore annulus 108.

Figure 3:
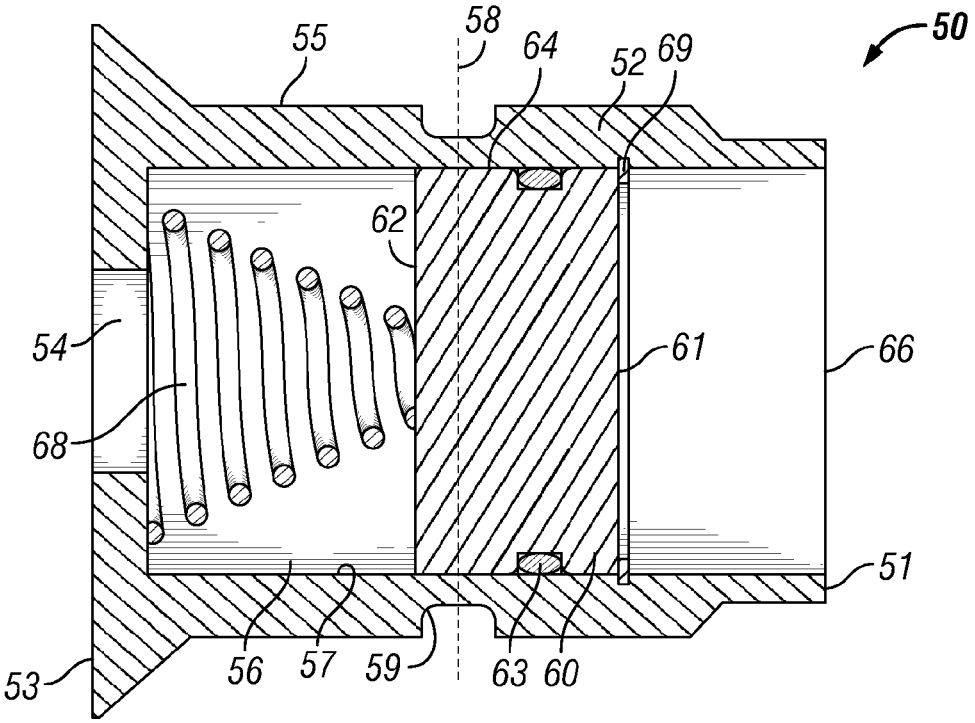
FIG. 3 is a cross-sectional view of another specific embodiment of a shear component disclosed herein shown in a first position.
Figure 4:
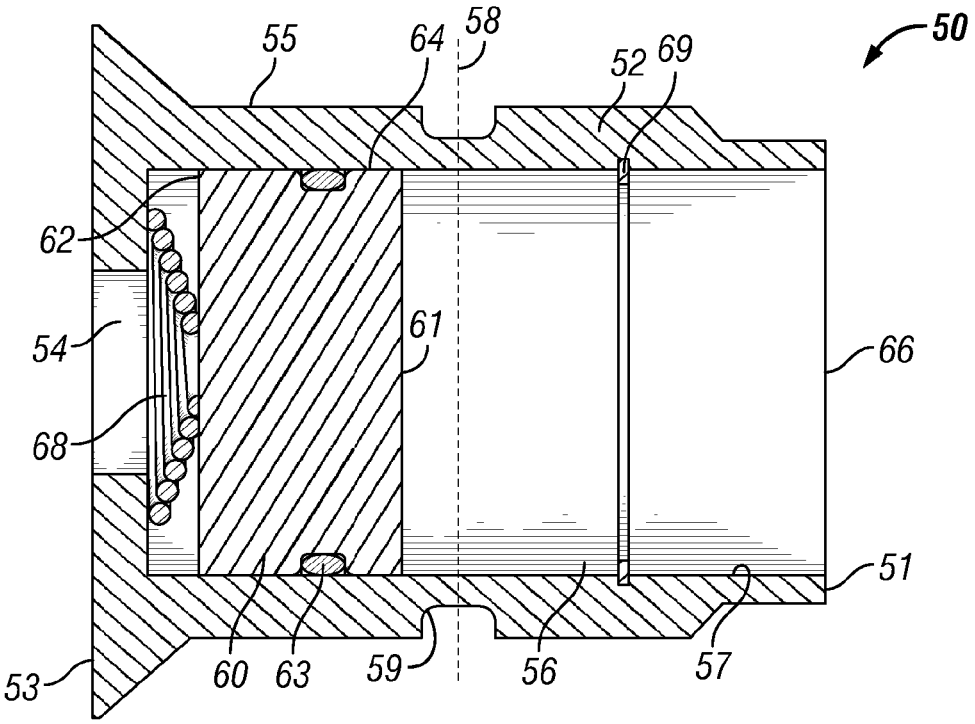
FIG. 4 is a cross-sectional view of the shear component shown in FIG. 3 shown in a second position.

With reference to FIGS. 3-4, in another embodiment, shear component 50 comprises body 52 having first end 51 having opening 66, second end 53 having opening 54, outer wall surface 55, and cavity 56 defined by inner wall surface 57. Opening 54 can be a hex-hole to facilitate installation of shear component 50 into a downhole tool. Outer wall surface 55 includes groove 59 disposed along shear plane 58. Shear plane 58 is the plane passing through body 52 which is the weakest point along body 52 and along which body 52 is compromised or broken.

Openings 54, 66 are in fluid communication with opposite ends of cavity 56. As shown in FIGS. 3-4, opening 66 is larger than opening 54. Disposed within cavity 56 in sliding engagement with inner wall surface 57 is core 60. Core 60 includes first end 61, second end 62, and seal ring 63 disposed along outer diameter 64 of core 60. Seal ring 63 can be any elastomeric ring such as an O-ring to reduce leakage of fluid between the interface of core 60 with inner wall surface 57 of body 52.

Core 60 has a first position (FIG. 3) and a second position (FIG. 4). In the first position, core 60 is disposed within cavity 56 across, or in alignment with, shear plane 58 and held between compressive member 68 and retaining ring 69. Thus, in the first position, the shear strength of body 52 is higher across shear plane 58 as compared to when core 60 is moved out of alignment of shear plane 58, thereby reducing the possibility of unintentionally shearing. Core 60 can be formed out of any material desired or necessary to provide strength to shear component 50 such that reduces the likelihood of unintentional shearing. Suitable materials include the materials listed above with respect to core 30.

In the embodiment of FIGS. 3-4, compressive member 68 comprises a coiled spring. However, compressive member 68 is not required to be a spring, but instead can be an elastomeric material, Belleville washers, or any other material or device that can be compressed to store energy that can later be released.

When core 60 is in the first position (FIG. 3), compressive member 68 is in its expanded or released energy position. In other words, compressive member 68 is pushing core 60 toward first end 51 and, thus, into retaining ring 64. Accordingly, compressive member 68 facilitates retaining core 60 in the first position.

In operation of the embodiment of FIGS. 3-4, and with further reference to FIGS. 7-8, downhole tool 100 (FIGS. 7-8) is shown disposed within wellbore 106 to define wellbore annulus 108. Shear component 50 is disposed through first component 102 and second component 104 (FIG. 7) such that first end 51 and second end 53 are exposed to bore 101 of downhole tool 100 and wellbore annulus 108, respectively.

After assembly, downhole tool 100 is run-in to wellbore 106 to the desired location on a work or tool string (not shown). A stimulus such as fluid pressure is pumped down bore 101 of downhole tool 100. The fluid pressure passes through opening 66 and enters cavity 56. The fluid pressure then exerts force on first end 61 of core 60 causing core 60 to slide along inner wall surface 57 of body 52 toward second end 53. In so doing, compression member 68 is moved from an expanded position (FIG. 3) to a compressed position (FIG. 4) and core 60 is moved from its first position (FIG. 3) to its second position (FIG. 4). As a result, core 60 is no longer disposed across, or in alignment with, shear plane 58. By moving core 60 out of alignment with shear plane 58, body 52 of shear component 50 is weakened so that body 52 is more readily compromised or broken due to a stimulus such as gravity, mechanical force, or fluid pressure acting on shear component 50. With reference to FIGS. 7-8, shear component 50 is compromised by fluid pressure building above ball 110 forcing ball 110 into first component 102 which, in turn, exerts force across shear plane 58 of shear component 50. After shear component 50 is compromised or otherwise fails, first component 102 is permitted to move relative to second component 104 such as shown in FIG. 8 so that a downhole operation is performed by the downhole tool. In the case of downhole tool 100, ports 105 are opened such that bore 101 is placed in fluid communication with wellbore annulus 108.

Figure 5:
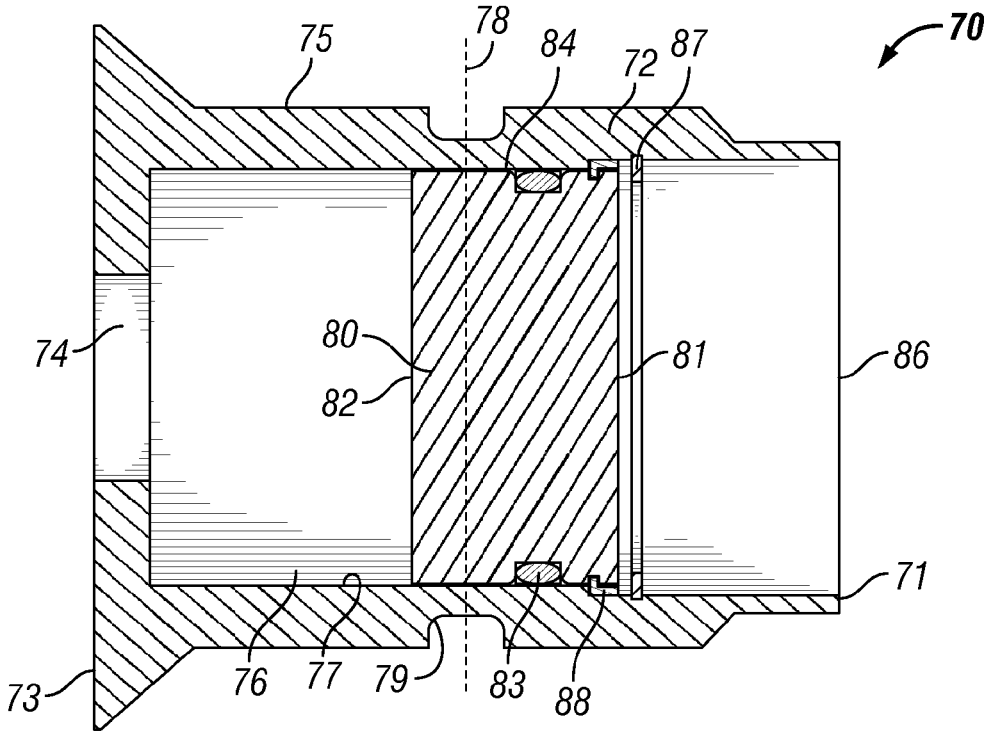
FIG. 5 is a cross-sectional view of an additional specific embodiment of a shear component disclosed herein shown in a first position.

Referring now to FIGS. 5-6, in another embodiment, shear component 70 comprises body 72 having first end 71 having opening 86, second end 73 having opening 74, outer wall surface 75, and cavity 76 defined by inner wall surface 77. Opening 74 can be a hex-hole to facilitate installation of shear component 50 into a downhole tool. Outer wall surface 75 includes groove 79 disposed along shear plane 78. Shear plane 78 is the plane passing through body 72 which is the weakest point along body 72 and along which body 72 is compromised or broken.

Openings 74, 86 are in fluid communication with opposite ends of cavity 76. As shown in FIGS. 5-6, opening 86 is larger than opening 74. Disposed within cavity 76 in sliding engagement with inner wall surface 77 is core 80. Core 80 includes first end 81, second end 82, and seal ring 83 disposed along outer diameter 84 of core 80. Seal ring 83 can be any elastomeric ring such as an O-ring to reduce leakage of fluid between the interface of core 80 with inner wall surface 77 of body 72.

Core 80 has a first position (FIG. 5) and a second position (FIG. 6). In the first position, core 80 is disposed within cavity 76 across, or in alignment with, shear plane 78. Core 80 is held in the first position by retaining ring 87 and shear ring 88. Thus, in the first position, the shear strength of body 72 is higher across shear plane 78 as compared to when core 80 is moved out of alignment of shear plane 78, thereby reducing the possibility of unintentionally shearing. Core 80 can be formed out of any material desired or necessary to provide strength to shear component 70 such that reduces the likelihood of unintentional shearing. Suitable materials include the materials listed above with respect to core 30.

In operation of the embodiment of FIGS. 5-6, and with further reference to FIGS. 7-8, downhole tool 100 (FIGS. 7-8) is shown disposed within wellbore 106 to define wellbore annulus 108. Shear component 70 is disposed through first component 102 and second component 104 (FIG. 7) such that first end 71 and second end 73 are exposed to bore 101 of downhole tool 100 and wellbore annulus 108, respectively.

After assembly, downhole tool 100 is run into wellbore 106 to the desired location on a work or tool string (not shown). A stimulus such as fluid pressure is pumped down bore 101 of downhole tool 100. The fluid pressure passes through opening 86 and enters cavity 76. The fluid pressure then exerts force on first end 81 of core 80 causing shear ring 88 to be compromised or broken so that core 80 can slide along inner wall surface 77 of body 72 toward second end 73. In so doing, core 80 is moved from its first position (FIG. 5) to its second position (FIG. 6). As a result, core 80 is no longer disposed across, or in alignment with, shear plane 78. By moving core 80 out of alignment with shear plane 78, body 72 of shear component 70 is weakened so that body 72 is more readily compromised or broken due to a stimulus such as gravity, mechanical force, or fluid pressure acting downward on shear component 70. With reference to FIGS. 7-8, shear component 70 is compromised by fluid pressure building above ball 110 forcing ball 110 into first component 102 which, in turn, exerts force across shear plane 78 of shear component 70. After shear component 70 is compromised or is otherwise failed, first component 102 is permitted to move relative to second component 104 such as shown in FIG. 8 so that a downhole operation is performed by the downhole tool. In the case of downhole tool 100, ports 105 are opened such that bore 101 is placed in fluid communication with wellbore annulus 108.

It is to be understood that the invention is not limited to the exact details of construction, operation, exact materials, or embodiments shown and described, as modifications and equivalents will be apparent to one skilled in the art. For example, the corrodible member is not required to be held in place initially by a retaining ring. Instead, corrodible member itself may be affixed to the body to maintain the core in its first position until the corrodible member is sufficiently compromised or degraded such that the compressive member can overcome the corrodible member to push the core toward the second end. Further, the corrodible member is not required to be a ring having an opening in its middle. Instead, it can be a plate or other suitable shaped member. In addition, the groove in outer wall surface of the body of shear component is not required. Moreover, the term "shear plane" can be indistinguishable from any other plane along the length of the shear component. Thus, the term "shear plane" refers to the plane or planes along the length of the shear component that are compromised such that the shear component releases from its connection. Additionally, the openings in the first ends of the embodiments shown in FIGS. 3-6 are not required to be larger than the openings in the second ends of these embodiments. Instead, the openings in the first ends can be smaller than, or equal in size, to the openings in the second ends. Accordingly, the invention is therefore to be limited only by the scope of the appended claims.

What is claimed is:

1. A shear component for use in a downhole tool, the shear component comprising:

a body having a first end, a second end, an outer wall surface, an inner wall surface defining a cavity, and a shear plane; and a core disposed within the cavity and in sliding engagement with the inner wall surface of the body, the core comprising a first position in which the core is disposed across the shear plane, and a second position in which the core is not disposed across the shear plane.

2. The shear component of claim 1, wherein the core is retained in the first position by a corrodible member disposed at least partially within the cavity, at least a portion of the corrodible member being in fluid communication with the opening in the first end.

3. The shear component of claim 2, wherein the first end includes an opening and the second end is closed.

4. The shear component of claim 3, wherein the corrodible member is retained at least partially within the cavity by a retaining ring.

5. The shear component of claim 1, further comprising an actuator for moving the core from the first position to the second position.

6. The shear component of claim 5, wherein the actuator comprises a compressible member.

7. The shear component of claim 6, wherein the compressible member comprises a spring having a compressed position when the core is in the first position and an expanded position when the core is in the second position.

8. The shear component of claim 5, wherein the actuator comprises a compressible material having a compressed position when the core is in the first position and an expanded position when the core is in the second position.

9. The shear component of claim 5, wherein the actuator is disposed within the cavity.

10. The shear component of claim 1, wherein the first end includes a first opening, the second end includes a second opening, and the core is retained in the first position by a retaining ring acting on a first end of the core and a compressible member acting on a second end of the core, the retaining ring preventing the core from moving toward the first end and the compressible member moving from an expanded position to a compressed position when the core is moved from the first position to the second position.

11. The shear component of claim 10, wherein the compressible member comprises a spring.

12. The shear component of claim 1, wherein the first end includes a first opening, the second end includes a second opening, and the core is retained in the first position by a retaining ring acting on a first end of the core and a shear ring, the retaining ring preventing the core from moving toward the first end and the shear ring preventing movement of the core toward the second end until the shear ring is compromised.

13. The shear component of claim 1, wherein the outer wall surface of the body includes a groove disposed along the shear plane.

14. The shear component of claim 1, wherein corrosion permits the movement of the core from the first position to the second position.

15. A downhole tool comprising:

a first component;

a second component, the second component being releasably secured to the first component by a shear component, the shear component having a body having a first end, a second end, an outer wall surface, an inner wall surface defining a cavity, and a shear plane and a core disposed within the cavity and in sliding engagement with the inner wall surface of the body, the core comprising a first position in which the core is disposed across the shear plane, and a second position in which the core is not disposed across the shear plane.

16. The downhole tool of claim 15, wherein the first end of the shear component includes an opening and the second end is closed, and the core is retained in the first position by a corrodible member disposed at least partially within the cavity, at least a portion of the corrodible member being in fluid communication with the opening in the first end.

17. The downhole tool of claim 15, wherein the first end includes a first opening, the second end includes a second opening, and the core is retained in the first position by a retaining ring acting on a first end of the core and a compressible member acting on a second end of the core, the retaining ring preventing the core from moving toward the first end and the compressible member moving from an expanded position to a compressed position when the core is moved from the first position to the second position.

18. The downhole tool of claim 15, wherein the first end includes a first opening, the second end includes a second opening, and the core is retained in the first position by a retaining ring acting on a first end of the core and a shear ring, the retaining ring preventing the core from moving toward the first end and the shear ring preventing movement of the core toward the second end until the shear ring is compromised.

19. The downhole tool of claim 15, further comprising an actuator disposed within the cavity.

20. The downhole tool of claim 15, further comprising a compressible member disposed within the cavity, the compressible member moving from an expanded position to a compressed position when the core is moved from the first position to the second position.

21. A method of actuating a downhole tool, the method comprising:

(a) applying a first stimulus to a downhole tool causing movement of a core disposed in a cavity of a shear component to move from a first position to a second position, the core being disposed in alignment with a shear plane of the shear component when in the first position and the core being disposed out of alignment with the shear plane when in the second position;

(b) compromising the shear component causing a first component of the downhole tool to be able to move relative to a second component of the downhole tool;

(c) applying a second stimulus to the downhole tool to the first component causing the first component to move from an initial position to an actuated position to cause actuation of the downhole tool.

22. The method of claim 21, wherein the first stimulus is a corrosive material.

23. The method of claim 21, wherein during (a), a compressible member facilitates movement of the core from the first position to the second position.

24. The method of claim 21, wherein the first stimulus is a fluid pressure.

25. The method of claim 24, wherein during (a), a compressible member moves from an expanded position to a compressed position due to the fluid pressure acting on the core.

26. The method of claim 21, wherein (b) and (c) are performed simultaneously.

27. A method of actuating a downhole tool comprising:

exposing a downhole tool to a first stimulus, the exposure to the first stimulus causing movement of a core disposed in a cavity of a shear component to move from a first position to a second position, the core being disposed in alignment with a shear plane of the shear component when in the first position and the core being disposed out of alignment with the shear plane when in the second position; and compromising the shear component causing a first component of the downhole tool to be able to move relative to a second component of the downhole tool.

28. The method of claim 20, further comprising exposing a second stimulus to the downhole tool to the first component, the exposure causing the first component to move from an initial position to an actuated position to cause actuation of the downhole tool.

* * * * *